12/1/87 XR 4,710,734

United States Patent [19]

Sterns

[11] Patent Number: 4,710,734

[45] Date of Patent: Dec. 1, 1987

[54] MICROWAVE POLARIZATION CONTROL NETWORK

[75] Inventor: William G. Sterns, Canoga Park, Calif.

[73] Assignee: ITT Gilfillan, a Division of ITT Corporation, Van Nuys, Calif.

[21] Appl. No.: 871,210

[22] Filed: Jun. 5, 1986

[51] Int. Cl.[4] ..... H01P 1/10; H01P 1/161; H01P 1/17

[52] U.S. Cl. ..... 333/101; 333/137; 333/21 A; 343/756

[58] Field of Search ..... 333/101, 109, 125, 137, 333/21 A; 343/756

[56] References Cited

U.S. PATENT DOCUMENTS 4,119,967 10/1978 Johnson et al. ..... 343/756 X 4,231,000 10/1980 Schuegraf ..... 333/109

*Primary Examiner*—Paul Gensler

*Attorney, Agent, or Firm*—Robert A. Walsh; Mary C. Werner

[57] ABSTRACT

This invention relates to two embodiments of microwave polarization control networks. The first produces two sets of orthogonal linear polarizations and constitutes a two position transfer switch and a directional coupler having two ports alternating as input and isolated ports and two ports alternating as through and coupled output ports. The transfer switch is connected to switch an input to one or the other of the two ports alternating as input and isolated ports and couple the other to a termination. An ortho-mode transducer junction, having two input ports, has one input port coupled directly to one of the output ports of the directional coupler and the other input port connected in series through a 0°/180° phase shifter to the other output port of the directional coupler. A dual mode waveguide is employed for transmitting a variable polarization output from the ortho-mode junction. In another embodiment, the transfer switch is not employed, and a 90° differential phase shifter is incorporated in the dual mode waveguide whereby either linear or circular polarization may be obtained.

4 Claims, 8 Drawing Figures

POLARIZATION STATES
POLARIZATION CONTROL
NETWORK

| POLARIZATION | S1 | S2 | S3 | S4 | S5 |
|---|---|---|---|---|---|
| HORIZONTAL | 0 | 0 | – | 0 | 0 |
| VERTICAL | 0 | 1 | – | 0 | 0 |
| +45 | 0 | 0 | – | 1 | 0 |
| -45 | 0 | 1 | – | 1 | 0 |
| RCP | 1 | – | 0 | – | 1 |
| LCP | 1 | – | 1 | – | 1 |

MICROWAVE POLARIZATION CONTROL NETWORK

BACKGROUND OF THE INVENTION

1. Field of the Invention

The invention relates generally to a microwave polarization control network and more particularly to such a network capable of rotating the plane of polarization of the wave in the output dual mode waveguide.

2. Description of the Prior Art

Polarization control networks are knwon in the microwave prior art employing a dual mode transducer followed by a microwave section mountd on bearings for mechanical rotation to produce a rotating linear (if $\Delta\Phi=180°$) or circular (if $\Delta\Phi=90°$) polarization in the output. Such a scheme requires bearings and a motor to rotate and is complex and expensive and of slower speed than electrical switching. It is, however, capable of providing a multitude of polarizations.

Prior Art U.S. Pat. No. 4,266,203 Saudreau et al, controls the polarization after the energy has been radiated by an antenna, in other words, a space polarization screen. Configurations such as this provides some degree of control and have been around for some time.

U.S. Pat. No. 4,293,858 Hockham, discloses a variable polarization linear array which could be used as a line source feed for a cylindrical reflector or in a two-dimensional array forming a narrow beam in both planes.

The present invention provides a plurality of polarizations unlike Saudreau et al, and provides a polarization agility for either horn-type antennas, which radiate directly, or for smaller feed horns for doubly curved reflectors producing narrow beams, unlike Hockham, which could be used as a line source feed for a cylindrical reflector or in a two-dimensional array forming a narrow beam in both planes. The horn-type is best suited for ECM applications such as jamming. The doubly curved reflector finds most use in radar systems where polarization agility or switchability is desired for weather penetration (circular polarization) or ECCM. The type of orthogonal signals radiated by the present invention (right-hand circular and left-hand circular, vertical and horizontal linear, plus 45° and minus 45° linear) is selected by the switches within the four-port network.

The manner in which the present invention functions and its advantages over the prior art will be better understood as the description proceeds.

SUMMARY OF THE INVENTION

Accordingly, it is one object of the invention to provide a microwave polarization control network capable of rotating the plane of polarization of the wave in the output dual mode waveguide.

It is another object of the invention to provide such a network which employs components well known in the art.

It is still another object of the invention to provide such a network in which the purity of the polarization in the output dual mode waveguide can be made arbitrarily good, limited only by the quality and bandwidth of the components and the skill of the designer in maintaining equal electrical paths.

It is still another object of the invention to provide such a network which uses R.F. switches, either waveguide or co-ax, which, although mechanical moving parts, operate in milliseconds. Solid state switches could be used for low power and then switching could be done in microseconds.

It is yet another object of the invention to provide such a network which is lossless except for the resistive loss in the components.

Still another object of the invention is to provide such a network which is realizable in waveguide or a combination of waveguide and TEM transmission media, such as co-ax, stripline, microstrip, etc.

It is yet another object of the invention to provide such a network which dependent upon switch states will result in linear, vertical, horizontal plus 45° or minus 45° polarization with a nearly arbitrary degree of purity.

These and other objects are achieved by providing in one embodiment a microwave polarization control network comprising a two position transfer switch, and a directional coupler having two ports alternating as input and isolated ports and two ports alternating as through and coupled output ports. The transfer switch is connected to switch an input to one or the other of the two ports alternating as input and isolated ports and couple the other to a termination. An ortho-mode transducer junction has two input ports, one coupled directly to one of the output ports of the directional coupler and the other coupled through a 0/180° phase shifter in series to the other output port of the directional coupler. A dual mode waveguide is employed for transmitting a variable polarization output from the ortho-mode junction to produce two sets of orthogonal linear polarizations.

In another embodiment of the invention, the transfer switch is not employed and a 90° differential phase shifter is incorporated in the dual mode waveguide whereby either linear or circular polarization may be obtained.

In one embodiment of the invention, the directional coupler is an 8.343 db coupler having a voltage output ratio of tangent 22.5° from two lines of the coupler.

The novel features that are considered characteristic of this invention are set forth with particularlity in the appended claims. The invention and further objects and advantages thereof will best be understood from the following description when read in connection with the accompanying drawings.

Figure 1:
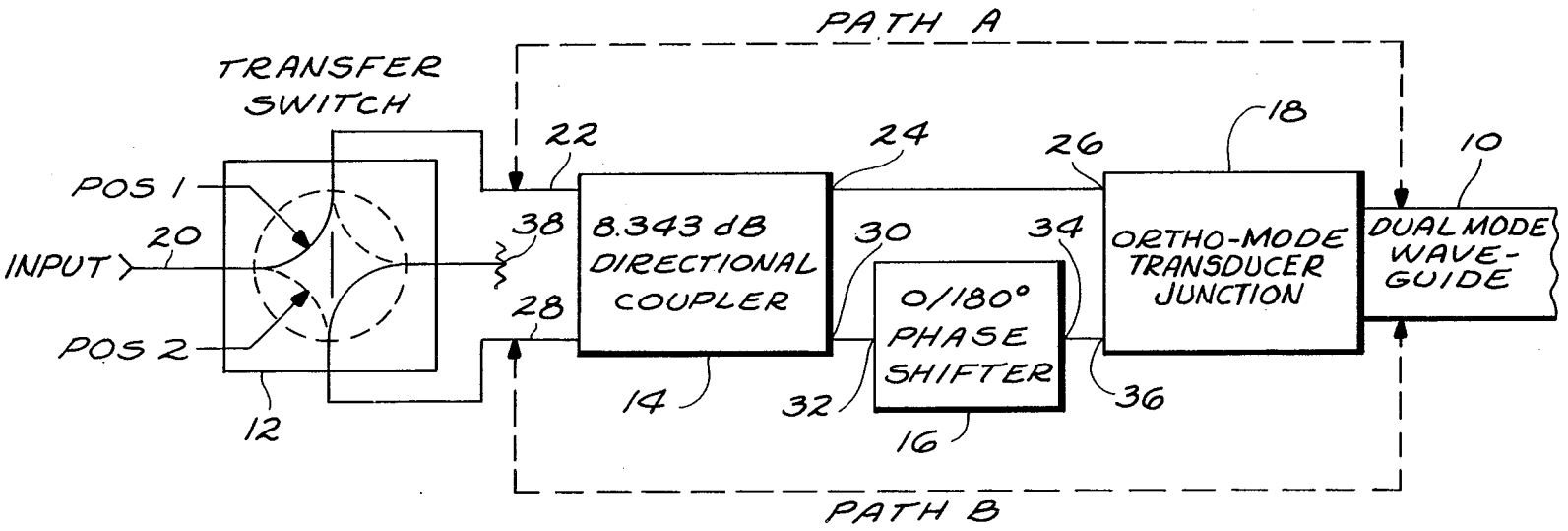
FIG. 1 is a block diagram of a one embodiment of the microwave polarization control network of the invention.

FIG. A–D is a drawing showing the polarization states of the polarization control network of FIG. 1.

Figure 3:
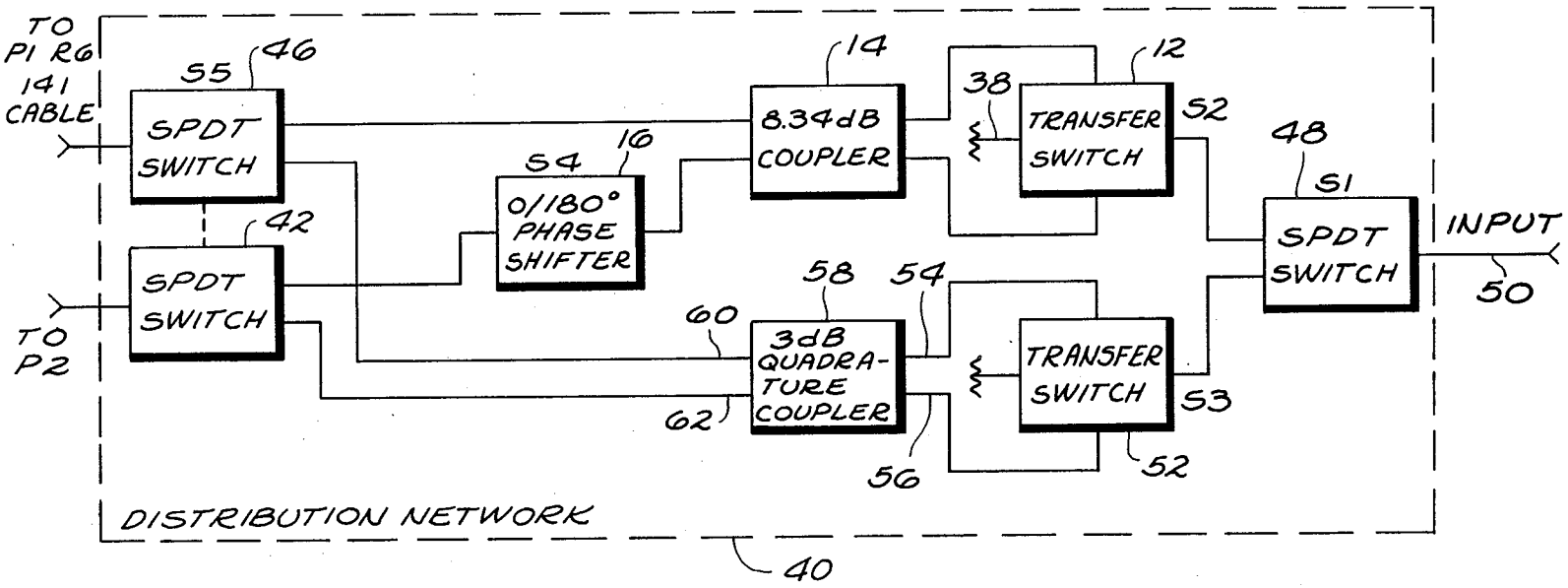

FIG. 3 is a block diagram of a distribution network employing the embodiment of FIG. 1 of the present invention in the upper half thereof.

Figure 4:
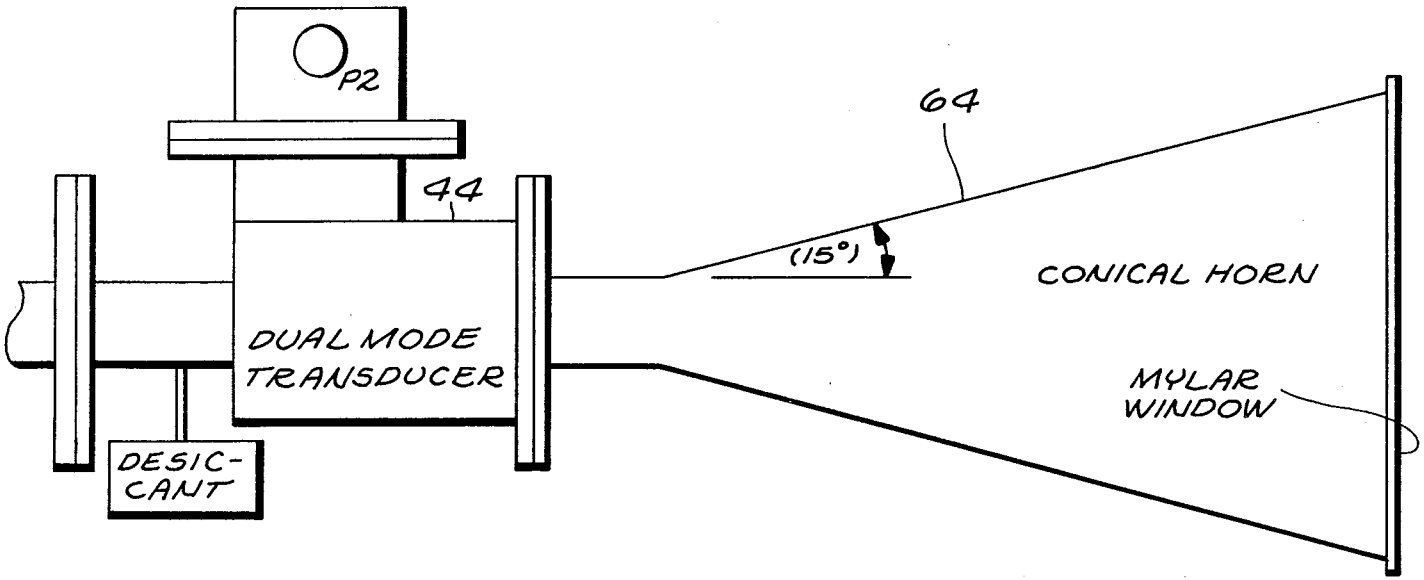

FIG. 4 is a drawing of a conical horn which is fed by the block diagram of FIG. 3.

Figure 5:
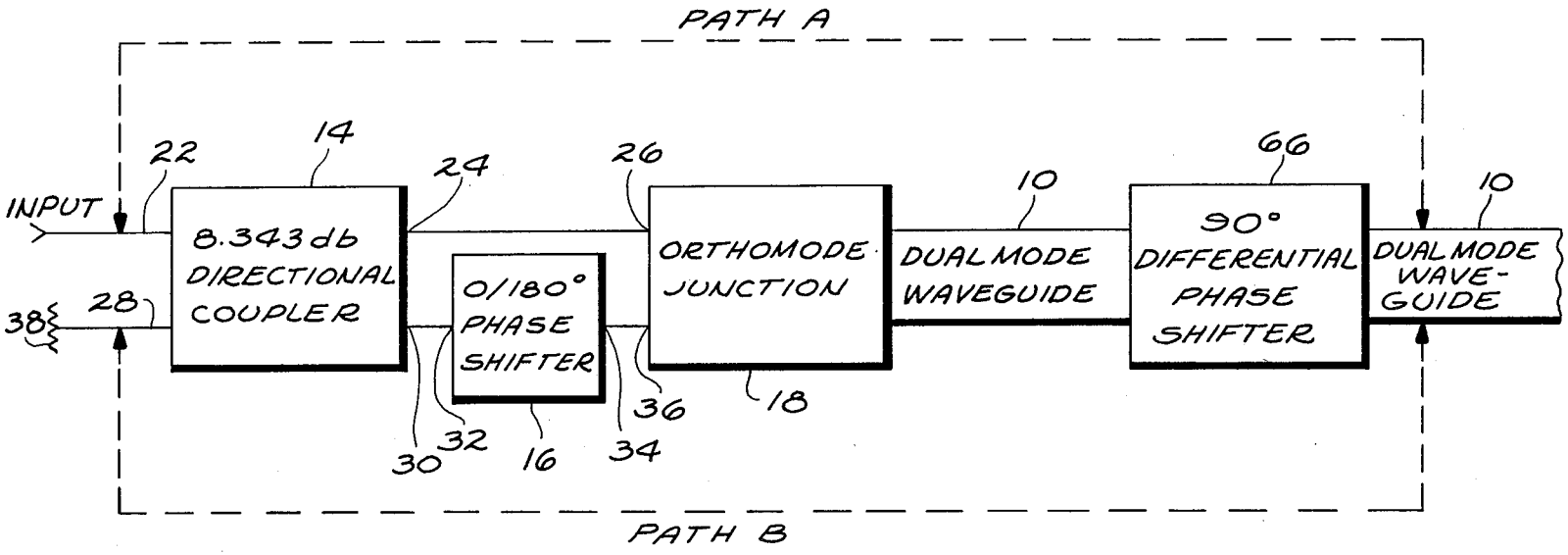

FIG. 5 is a block diagram of an embodiment for obtaining either circular or linear polarization.

DESCRIPTION OF THE PREFERRED EMBODIMENT

The basic configuration of the network of the subject invention is shown in FIG. 1. The input power is divided between two channels of equal electrical length indicated as Path A and Path B, which are recombined in the output dual mode waveguide 10. All components shown in FIG. 1 are well known in the art. Transfer switches such as 12 may be either in waveguide, co-ax or diode control stripline form and are available from many component manufacturers. Directional couplers such as 14 are also common items. A coupling value of 8.343 db which produces an output voltage ratio of 1–0.4142 would require a specific design well within the skill of one skilled in the art. The 0/180° phase shifter 16 can be readily realized in waveguide by a rotable step twist section. 180° phase shifters are readily available in TEM mode components. The ortho-mode transducer junction also known as ortho-mode tees, or dual-mode transducer 18 is available from suppliers such as Microwave Development Laboratories, 10 Michigan Drive, Natick, Mass.

The input is applied to input 20 of transfer switch 12 which in position 1 is connected to Path A to the input port 22 of directional coupler 14. Path A continues from through output port 24 of coupler 14 to the input 26 of ortho-mode junction 18. Coupled port 30 of coupler 14 is connected to input 32 of 0/180° phase shifter 16 and from its output 34 to input 36 of ortho-mode junction 18. Isolated port 28 of coupler 14 is connected through transfer switch 12 to termination 38. The output of ortho-mode junction 18 is connected to dual mode waveguide 10.

Figure 2A:
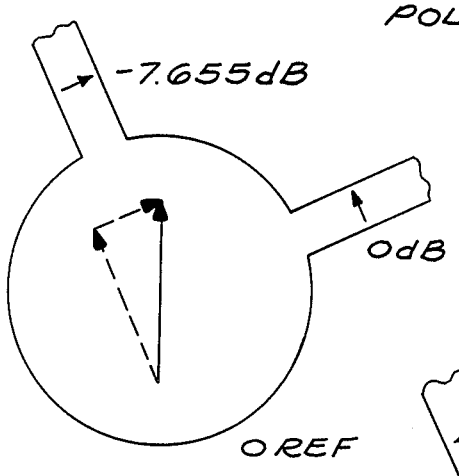
Figure 2B:
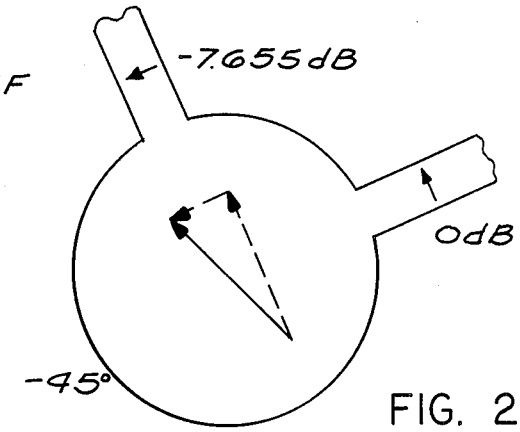
Figure 2C:
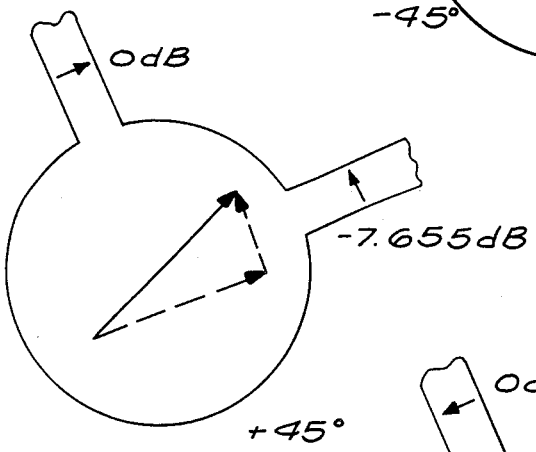
Figure 2D:
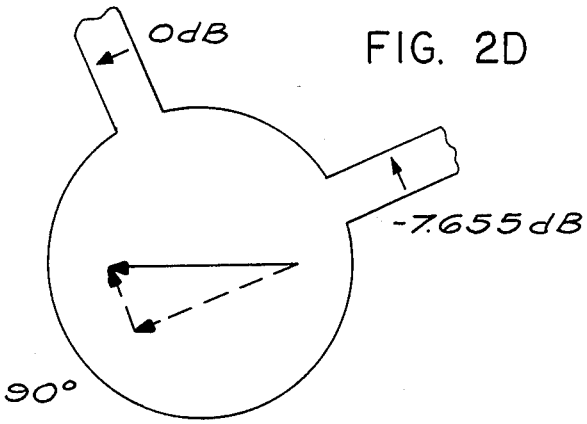

In position 2 of transfer switch 12 the input 20 would be connected to the port 28 which is the input port in this mode. The through port 30 is then coupled through phase shifter 16 to input 36 of ortho-mode junction 18. Coupled port 24 of coupler 14 in this mode is connected directly to input 26 of ortho-mode junction 18 and isolated port 22 is connected through switch 12 to termination 38. Again, the output of ortho-mode junction 18 is connected to dual mode waveguide 10. The network of FIG. 1 will, dependent upon the state of the transfer switch 12 and the phase shifter 16, result in the four polarization states such as shown in FIG. A–D. With switch 12 in position 1 and phase shifter 16 0°, the 0° polarization state shown in FIG. 2A will be implemented. With switch 12 in position 1 and phase shifter 16 at 180°, the minus 45° polarization shown in FIG. 2B will be implemented. With transfer switch 12 in position 2 and phase shifter 16 at 180° the polarization of plus 45° shown in FIG. 2C will be implemented. With transfer switch 12 in position 2 and phase shifter 16 at 0° the polarization of 90° shown in FIG. 2D will be implemented. Any space quadrature fields in the dual mode waveguide 10 are terminated in the load 38 connected to the transfer switch 12. The operation of the network can be described as follows. For convenience of description, the ortho-mode junction is rotated 22½°. Referring to FIG. 2A, the through output of the directional coupler 14, of relative voltage amplitude of 1.00 volt, excites a wave in the output of the ortho-mode junction with the voltage vector inclined 22½° from vertical. The coupled output from the directional coupler 14, which has a relative voltage of 0.4142 volts, passes through the 0/180° phase shifter in the "0" phase state and excites a wave in the ortho-mode output with the voltage vector inclined 22½° from horizontal. The path lengths A and B are designed so that these 2 voltage vectors are in-phase, so they add together to produce a vertically polarized wave in the ortho-mode output. To change the output polarization to −45°, the phase shifter 16 is activated, and the vector relation shown in FIG. 2B results. when the transfer switch is activated, the high and low power ports are interchanged, and the vector relationship of FIGS. 2C and 2D result.

FIG. 3 shows a distribution network 40 employing the invention in the upper section thereof, the lower section being prior art. This circuit also has transfer switch 12, coupler 14 and phase shifter 16 connected in one path through a single-pole, double-throw switch 42 to an output P2, which goes to the upper input P2 of ortho-mode junction or dual mode transducer 44, illustrated in FIG. 4. The coupled output of the coupler 14 goes to single-pole, double-throw switch 46 to output P1, which goes to theinput P1 (not shown in FIG. 4) of dual mode transducer 44. The fourth port of the coupler goes through the transfer switch 12 to termination 38. Either the upper section just described or the lower section to be described of FIG. 3 is selected by the single-pole, double-throw switch 48, which is connected from the input 50, either to transfer switch 12 or the transfer switch 52 in the lower section. Transfer switch 52 is connected in turn to one or the other inputs 54 or 56 of 3 db quadrature coupler 58, the two outputs 60 and 62 of which are connected to inputs of switches 46 and 42, respectively. Thus, switch 48 selects either the upper or lower portions of the distribution network 40.

The configuration described in FIGS. 3 and 4 involves an experiment that requires an antenna of modest gain and beam width, which with digitally controlled polarization operates near the middle of the S frequency band. The conical horn 64 of FIG. 4 will have a gain of about 20 db and a half power beam width of about 9°, and is fed with a high isolation dual mode transducer 44. The upper portion of the distribution network 40 employing the transfer switch 12, coupler 14, phase shifter 16 and dual mode transducer 44 will, dependent upon the switch states, result in a linear vertical, horizontal, plus 45°, or minus 45° polarization with a nearly arbitrary degree of purity as described in connection with FIGS. 1 and 2. The second path or the lower path in the distribution network will, when activated, result in right-hand circular polarization or left-hand circular polarization as well known in the prior art. The purpose of this embodiment of FIGS. 3 and 4 is to provide a polarization agile radiating source for radar system evaluation.

FIG. 5 is an embodiment of the invention without the transfer switch of FIG. 1 but otherwise identical to FIG. 1, except that a 90° differential phase shifter 66 is inserted in dual mode waveguide 10. This embodiment rotates the plane of linear polarization in the ortho-mode output 45° so that when the 90° phase shifter is incorporated in the ortho-mode output, either linear or circular polarization will obtain.

Since the principles of the invention have now been made clear, modifications which are particularly adapted for a specific situation without departing from those principles will be apparent to those skilled in the art. The appended claims are intended to cover such modifications as well as the subject matter described, and to only be limited by the true spirit of the invention.

What is claimed and desired to be secured by Letters Patent of the United States is:

1. A microwave polarization control network comprising a two position transfer switch for directing an input to one of two paths; a directional coupler having two ports, alternating as input and isolated ports, and two ports alternating as through output and coupled output ports; said two position transfer switch being connected to alternately switch an input to one or the other of said two ports of said directional coupler alternating as input and isolated ports and connect the other remaining one of said two ports, then called the isolated port, to a termination; an ortho-mode transducer junction having two input ports; means coupling one of said output ports to one input of said ortho-mode transducer junction; a 0/180° phase shifter coupled in series between the other of said output ports and the other input of said ortho-mode transducer junction; and a dual mode waveguide for transmitting a variable polarization output from said ortho-mode transducer junction to produce two sets of orthogonal linear polarizations.

2. The network of claim 1 in which said directional coupler is an 8.343 db coupler having a voltage output of tangent 22.5° between its two lines.

3. A microwave polarization control network comprising a directional coupler having input, through output, coupled and isolated ports; an ortho-mode junction having two input ports; means coupling said through output to one input of said ortho-mode junction; a 0/180° phase shifter; means coupling said coupled port through said phase shifter to the other input port of said ortho-mode junction; means coupling said isolated port to a termination; a dual mode waveguide for transmitting a variable polarization output from said ortho-mode junction having a 90° differential phase shifter incorporated therein whereby either linear or circular polarization may be obtained.

4. The network of claim 3 in which said coupler is an 8.343 db coupler having a voltage output of tangent 22.5° between its two lines.

* * * * *